US005930976A

United States Patent [19]

Boldrini et al.

[11] Patent Number: 5,930,976

[45] Date of Patent: Aug. 3, 1999

[54] PACKET WRAPPING UNIT

[75] Inventors: Fulvio Boldrini, Ferrara; Francesco Bertuzzi, Budrio, both of Italy

[73] Assignee: G.D Societa' per Azioni, Bologna, Italy

[21] Appl. No.: 08/901,020

[22] Filed: Jul. 25, 1997

[30] Foreign Application Priority Data

Jul. 26, 1996 [IT] Italy ..... BO96A0405
Dec. 4, 1996 [IT] Italy ..... BO96A0628

[51] Int. Cl.[6] ..... B65B 11/28

[52] U.S. Cl. ..... 53/234; 53/220; 53/225; 53/228; 53/232

[58] Field of Search ..... 53/209, 220, 221, 53/224, 225, 228, 232, 233, 234

[56] References Cited

U.S. PATENT DOCUMENTS

| | | | |
|---|---|---|---|
| 3,899,865 | 8/1975 | Revas | 53/234 |
| 3,992,855 | 11/1976 | Palmieri et al. | 53/234 X |
| 4,358,920 | 11/1982 | Kanai et al. | 53/234 X |
| 4,408,435 | 10/1983 | Sutton | 53/234 X |
| 4,428,177 | 1/1984 | Focke et al. | 53/234 X |
| 4,509,310 | 4/1985 | Focke et al. | 53/234 X |
| 4,646,508 | 3/1987 | Focke | 53/234 X |
| 4,823,536 | 4/1989 | Manservigi et al. | 53/234 X |
| 4,866,912 | 9/1989 | Deutsch | 53/234 X |
| 4,947,617 | 8/1990 | Focke et al. | 53/234 |
| 4,962,634 | 10/1990 | Boldrini et al. | 53/234 |
| 5,373,681 | 12/1994 | Shigeta | 53/234 X |
| 5,392,586 | 2/1995 | Imai | 53/234 |
| 5,406,775 | 4/1995 | Tacchi et al. | 53/234 X |
| 5,442,894 | 8/1995 | Ogata et al. | 53/234 |
| 5,461,841 | 10/1995 | Spada et al. | 53/234 |
| 5,490,368 | 2/1996 | Spatafora | 53/234 |
| 5,493,847 | 2/1996 | Spatafora | 53/234 X |
| 5,544,467 | 8/1996 | Focke | 53/234 X |

FOREIGN PATENT DOCUMENTS

| | | |
|---|---|---|
| 2068883 | 8/1981 | United Kingdom . |
| 2164913 | 4/1986 | United Kingdom . |

*Primary Examiner*—Daniel B. Moon
*Attorney, Agent, or Firm*—Klauber & Jackson

[57] ABSTRACT

A unit for wrapping packets, wherein a first seat, carried on a first conveyor, closed by a sheet of wrapping material and housing a packet, is brought into engagement with a second seat on a second conveyor to insert the packet inside the second seat and fold the sheet into a U about the packet; the first seat engaging a respective packet by the end surfaces of the packet; and the second seat engaging the packet by a pair of lateral walls crosswise to the end surfaces.

20 Claims, 5 Drawing Sheets

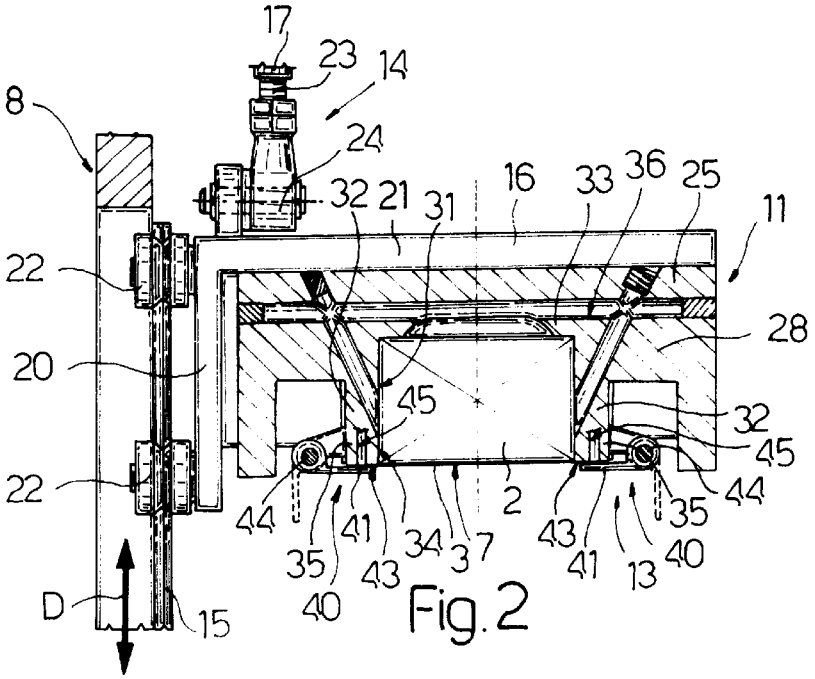
Fig. 2
Fig. 3
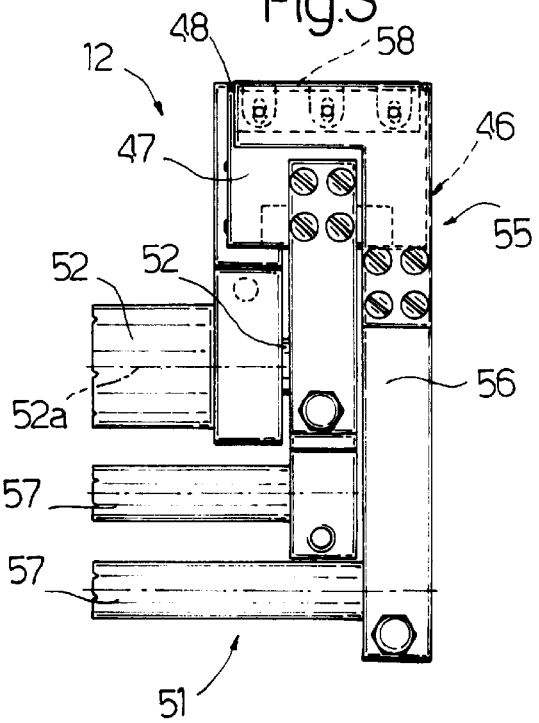
Fig. 4
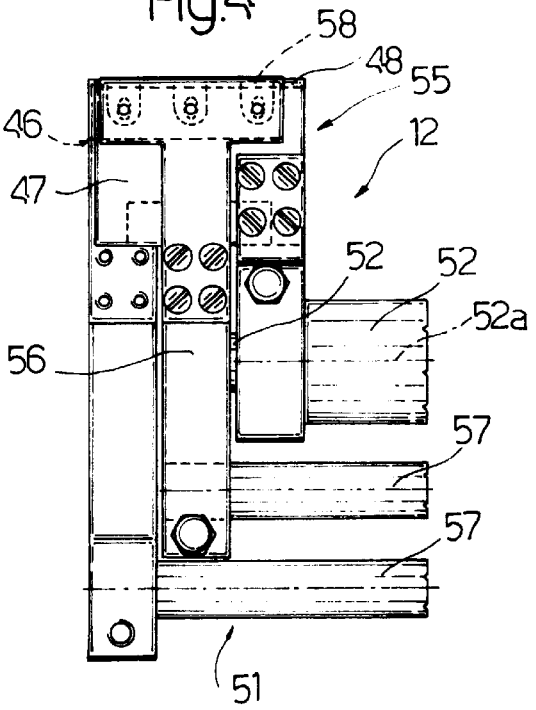

PACKET WRAPPING UNIT

BACKGROUND OF THE INVENTION

The present invention relates to a packet wrapping unit.

The present invention may be used to advantage on cigarette packing machines, in particular cellophaning machines, to which the following description refers purely by way of example.

On cellophaning machines, a packet for overwrapping is generally housed inside a first seat on a first conveyor, normally a conveyor wheel; the first seat is fed to a transfer station in time with a respective second seat on a second conveyor, normally another conveyor wheel; the two seats are aligned for a given length of time; a sheet of wrapping material is supplied to the transfer station and positioned between the two aligned seats; the packet is transferred from the first to the second seat so as to insert the packet inside the second seat together with the respective sheet of wrapping material, which is simultaneously folded into a U about the packet; the packet and respective sheet are released inside the second seat; and two portions of the sheet projecting from the second seat are folded on to the packet and sealed to each other to form a tubular wrapping about the packet.

The above operations for transferring the packets from one conveyor to the other and simultaneously folding the respective sheets of wrapping material into a U present several difficulties, in that correct folding of the sheet of wrapping material into a U about the respective packet normally requires the use of a folding spindle to guide the sheet as it is folded, and, at any rate, at least a sheet guiding device for preventing the sheet from slipping in relation to the packet. Moreover, on account of the thinness of the sheet of wrapping material and the relatively high speed at which the packet is inserted, the sheet, especially when of minimum thickness for ecological reasons, is invariably subject to damage.

SUMMARY OF THE INVENTION

It is an object of the present invention to provide a packet wrapping unit designed to simplify the above transfer operations as far as possible.

According to the present invention, there is provided a unit for wrapping packets of prismatic shape defined longitudinally by two ends and laterally by pairs of opposite lateral surfaces; the unit comprising a first and a second conveyor movable through a transfer station and respectively comprising at least a first and at least a second pocket; said first and said second pocket respectively comprising a first and a second seat for receiving and retaining a respective packet; and transfer means for transferring the packet from said first to said second seat at the transfer station; the unit being characterized in that said seats are so formed that the first engages a respective said packet by said ends and in such a manner as to leave free at least a first pair of said lateral surfaces, and the second engages the packet by said first pair of lateral surfaces.

BRIEF DESCRIPTION OF THE DRAWINGS

A non-limiting embodiment of the present invention will be described by way of example with reference to the accompanying drawings, in which:

FIGS. 2 to 8 show smaller-scale views, with parts in section and parts removed for clarity, of a FIG. 1 detail in respective operating positions;

FIGS. 9 to 12 show smaller-scale views in perspective of a FIG. 1 detail in respective operating conditions;

DETAILED DESCRIPTION OF THE INVENTION

Figure 1:
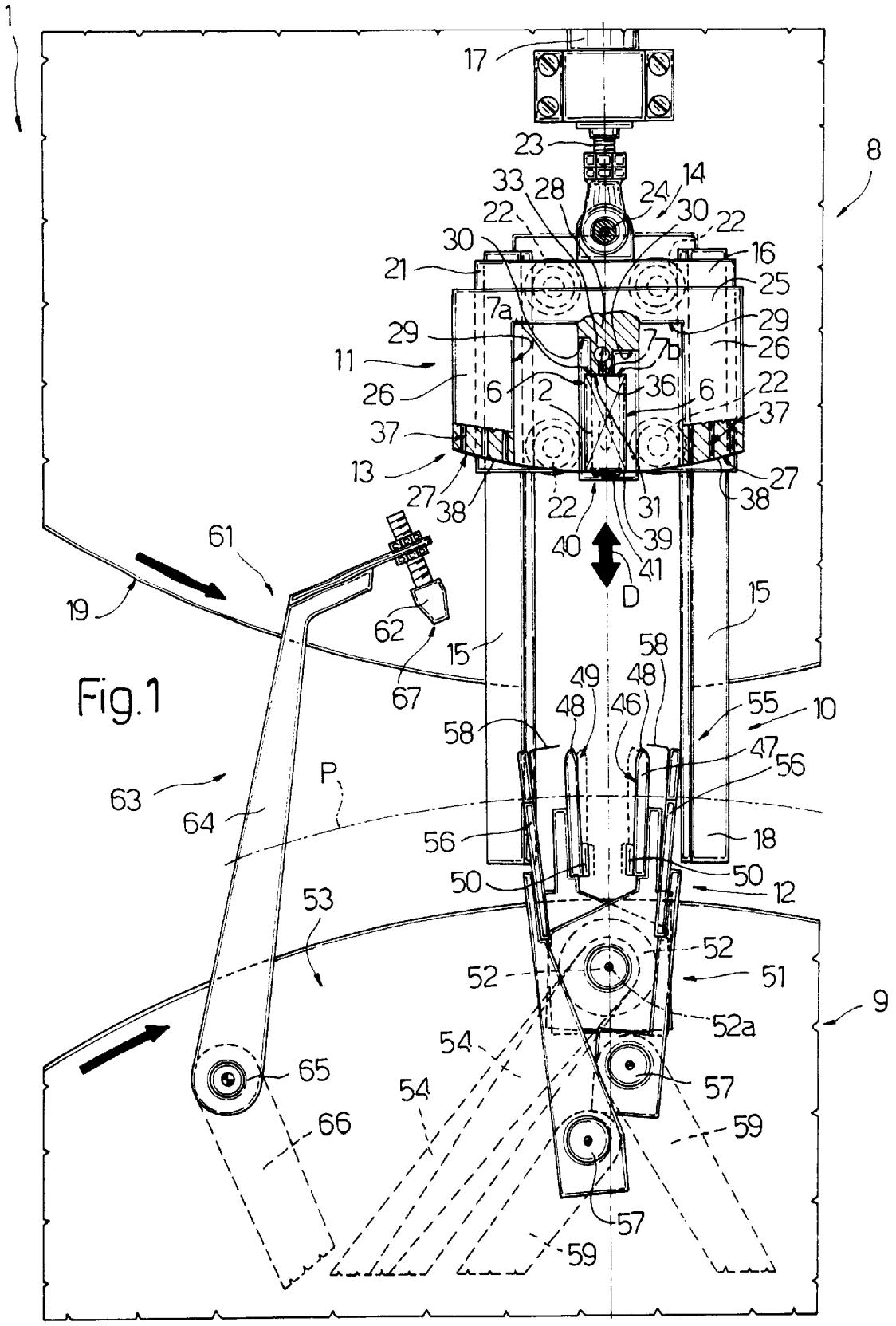
FIG. 1 shows a side view, with parts in section and parts removed for clarity, of a preferred embodiment of a wrapping unit in accordance with the teachings of the present invention.
Figures 5, 6, 9, 10, 11:
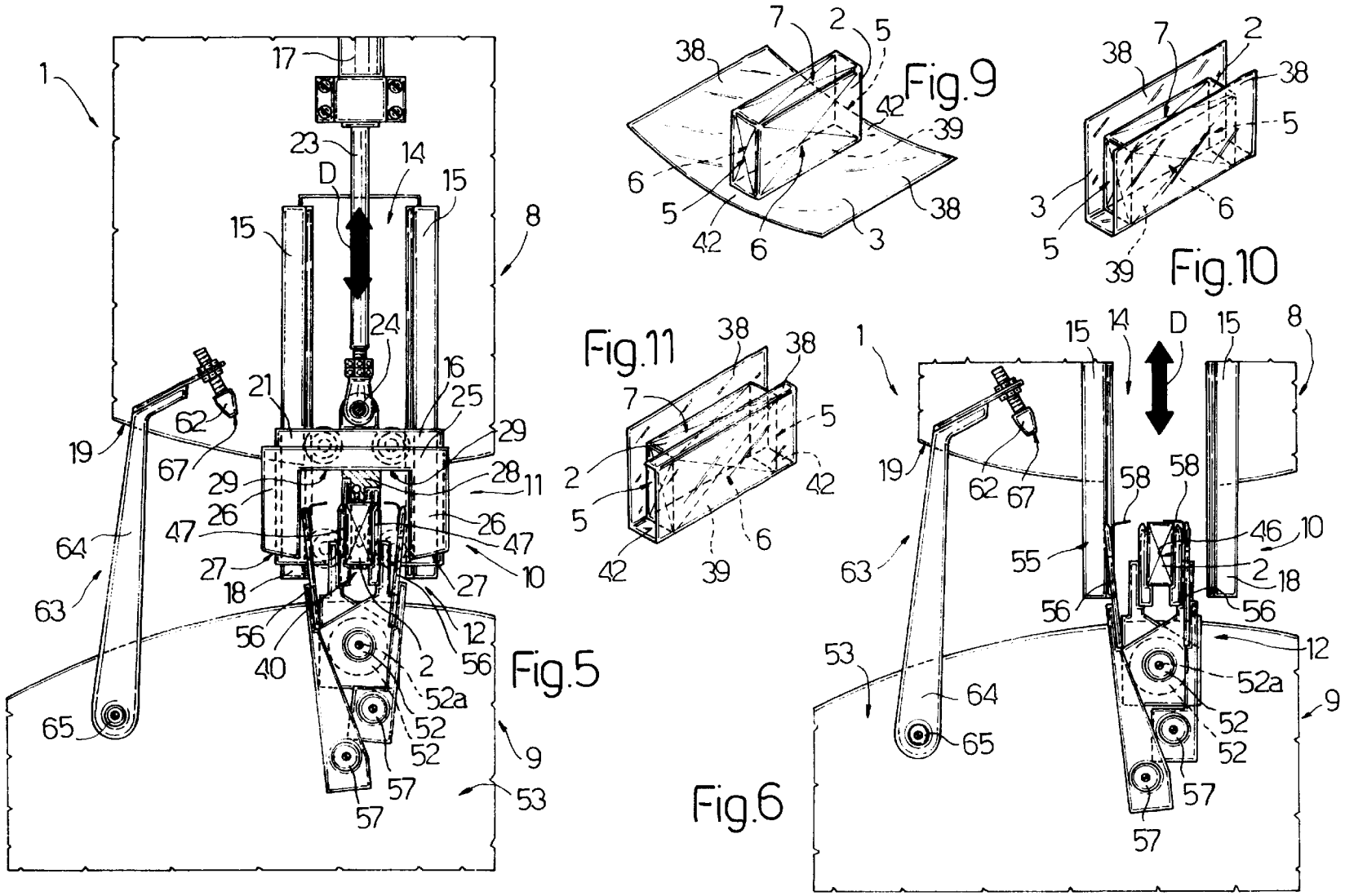
Figure 8:
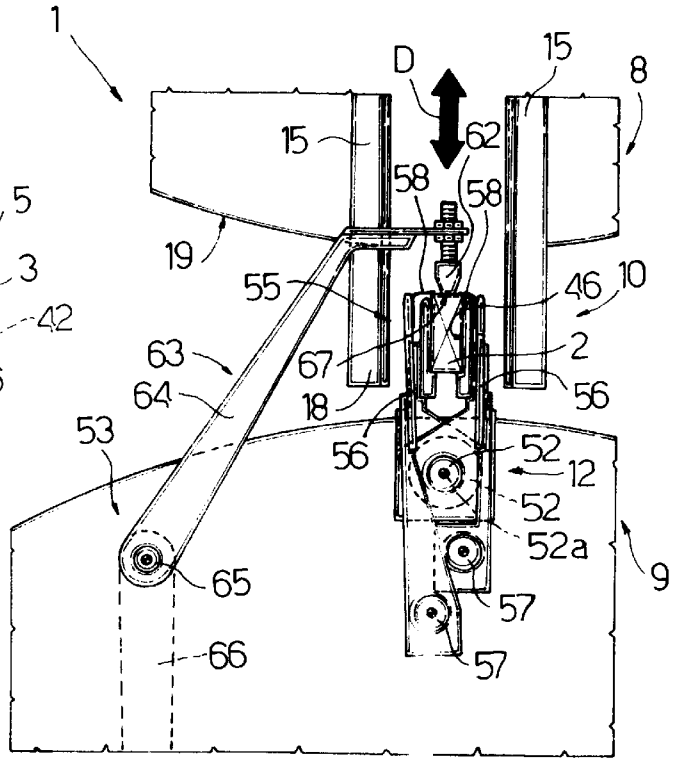
Figure 12:
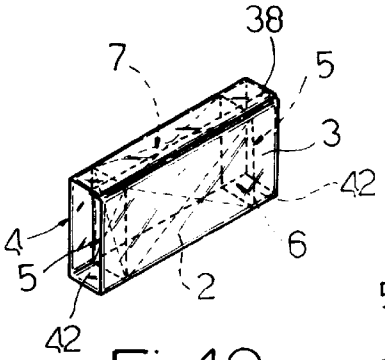
Figure 7:
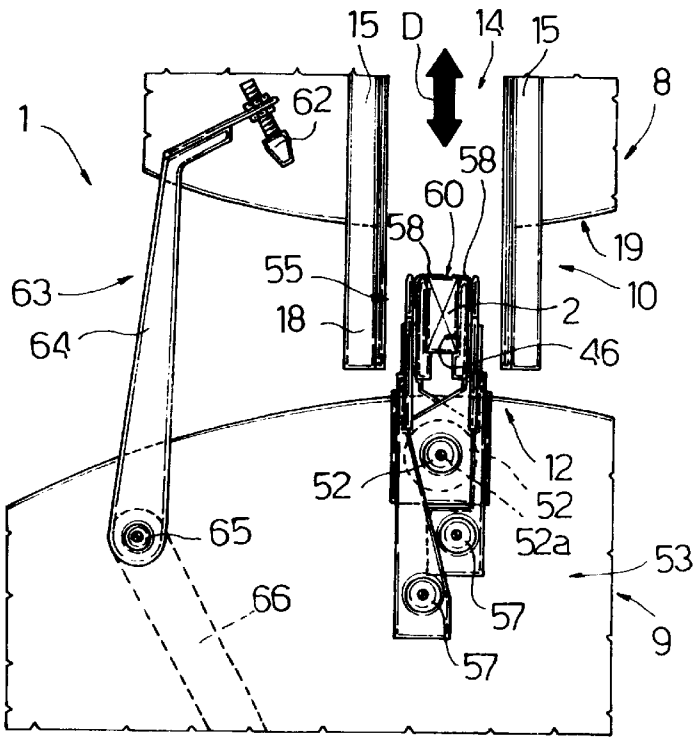

With reference to FIGS. 1, 9 and 12, number 1 indicates as a whole a wrapping unit for wrapping packets 2 of cigarettes (not shown) in respective sheets 3 of wrapping material to form a tubular wrapping 4 about each packet 2. Each packet 2 is defined longitudinally by two end surfaces 5, and laterally by two pairs of opposite surfaces 6 and 7, of which surfaces 6 are large lateral surfaces and surfaces 7 small lateral surfaces.

Unit 1 comprises two conveyor wheels 8 and 9 rotating in opposite directions about respective axes of rotation (not shown) and substantially tangent to each other at a transfer station 10. More specifically, wheel 8 is a supply wheel comprising a number of supply pockets 11 (only one shown), each for supplying station 10 with a respective packet 2 together with a sheet 3; and wheel 9 is a folding wheel comprising a number of folding pockets 12 (only one shown), each of which is fed through station 10 in time with a pocket 11 to receive a packet 2 and respective sheet 3 from respective pocket 11.

In the embodiment shown in the accompanying drawings, pockets 11 and 12 are substantially fixed in relation to respective wheels 8 and 9, which are rotated in steps. Nevertheless, wheels 8 and 9 may of course be rotated continuously, and pockets 11 and 12 may be movable in relation to respective wheels 8 and 9 and orientable in relation to each other as described and illustrated in U.S. Pat. No. 4,823,536.

For each pocket 11, wheel 8 comprises a retaining device 13 for releasably retaining a packet 2 and a respective sheet 3 respectively inside and contacting pocket 11; and a transfer device 14 for transferring a packet 2, together with respective sheet 3, from pocket 11 to a respective pocket 12 at transfer station 10 by moving pocket 11 to and from a transfer position engaging pocket 12 (FIG. 5). Device 14 comprises a pair of radial guides 15 integral with wheel 8; and a slide 16 supporting pocket 11 and moved along guides 15 by a linear actuator 17. More specifically, guides 15 are parallel to each other in a radial direction D of wheel 8, and each have an end portion 18 projecting radially with respect to a peripheral outer surface 19 of wheel 8. As shown in FIG. 2, slide 16 comprises two plates 20 and 21, of which plate 20 is crosswise to said axis of rotation of wheel 8 and comprises two pairs of wheels 22 engaging guides 15 in rolling manner, and plate 21 is crosswise to plate 20 and extends parallel to said axis of rotation, on the opposite side of plate 20 to wheels 22. Actuator 17 comprises an output rod 23 hinged to plate 21 by a hinge 24 parallel to said axis of rotation, and provides for moving respective pocket 11, along guides 15, between a traveling position (FIG. 1) in which pocket 11 is housed inside wheel 8 with respect to surface 19, and said transfer position (FIG. 5) in which pocket 11 is substantially located at end portions 18 of guides 15 to receive a respective packet 2 together with respective sheet 3.

Each pocket 11 comprises a bottom wall 25 integral with and parallel to plate 21; two lateral walls 26 extending transversely from wall 25 towards surface 19, and defined radially by respective substantially cylindrical surfaces 27 having substantially the same curvature; and a central partition 28 extending from wall 25, and which is aligned with hinge 24, is parallel to and located between walls 26, and defines, with walls 26, two gaps 29 open both longitudinally and radially. Central partition 28 comprises two lateral cavities 30 formed as of gaps 29 and having, in a radial plane through said axis of rotation of wheel 8, a longitudinal dimension of a length at least equal to the length of a packet 2 measured between surfaces 5. Partition 28 also comprises a central seat 31 formed between cavities 30, and for receiving a respective packet 2 and connecting gaps 29.

More specifically, each central seat 31 is defined longitudinally by two lateral walls 32 parallel to direction D and for engaging respective packet 2 by end surfaces 5 so that the two large lateral surfaces 6 are left free and positioned directly facing gaps 29. Each seat 31 is also defined transversely by a bottom wall 33 crosswise to direction D, and which provides for engaging one of small lateral surfaces 7 and is narrower than the thickness of packet 2 so that two longitudinal portions 7*a*, 7*b* of surface 7 are left free; and by an opening 34 in turn defined by two free end portions 35 of walls 31, and which is occupied by the other small lateral surface 7.

Retaining device 13 is associated with lateral walls 26 of pocket 11 and with walls 32 and 33 of partition 28, and comprises a number of suction conduits 36 formed inside walls 32 and 33 and communicating at one end with a known suction device (not shown) and at the other end with seat 31 to retain packet 2 inside seat 31. Device 13 also comprises a number of further suction conduits 37 formed inside walls 26, connected to a respective known suction device (not shown), and terminating at surfaces 27 to retain a sheet 3 by suction in a position substantially closing opening 34 and gaps 29, with lateral end portions 38 contacting respective surfaces 27, and with a central portion 39 substantially contacting the surface 7 of packet 2 facing opening 34.

Finally, device 13 comprises two gripping elements 40 defined by respective plates 41 mounted for rotation on either side of opening 34 at portions 35, and which provide for clamping sheet 3 in a fixed position with respect to opening 34 by gripping two central lateral portions 42 of sheet 3, located on either side of central portion 39, on to respective end surfaces 43 of portions 35. More specifically, plates 41 are mounted for rotation about respective hinges 44 parallel to each other and crosswise to said axis of rotation and direction D, and are rotated between a clamping position (FIG. 2) contacting surfaces 43, and a raised open position (shown by the dotted line in FIG. 2) in which they are detached from surfaces 43 to enable a known supply device (not shown) to feed a sheet 3 to pocket 11, and to enable sheet 3 to leave pocket 11 after being folded into a U about packet 2 as described later on.

According to a variation of device 13 also shown in FIG. 2, gripping elements 40 are replaced by respective suction conduits 45 formed through walls 32 and communicating at one end with a respective known suction device (not shown) and at the other end with surfaces 43 to retain portions 42 on surfaces 43 by suction.

As shown in FIGS. 3 and 4, each pocket 12 comprises a seat 46, which, when a corresponding pocket 11 is set in use to said transfer position, is positioned to coincide with a respective seat 31 to receive a packet 2 together with sheet 3 and simultaneously fold sheet 3 into a U about packet 2. More specifically, seat 46 is located outwards of a peripheral surface of wheel 9, and is defined by two lateral walls 47 having respective substantially rounded upper longitudinal edges 48 defining an input opening 49 of seat 46, and two transverse bottom projections 50 parallel to edges 48 and defining the bottom wall of seat 46. As pocket 11 is moved along guides 15, walls 47 are inserted inside gaps 29 so that respective edges 48 intercept sheet 3 on either side of portion 39 and gradually fold sheet 3 into a U about packet 2, and so as to eventually engage large lateral surfaces 6 of packet 6.

In the FIGS. 3 and 4 embodiment, walls 47 are movable to and from each other between an open position (FIG. 1) in which packet 2 is inserted inside seat 46 in such a manner as to simultaneously smooth sheet 3 on to lateral surfaces 6 in cooperation with retaining device 13, and a closed position (FIGS. 5, 6, 7 and 8) in which packet 2 is clamped and retained inside seat 46. More specifically, each pocket 12 comprises an actuating device 51, in turn comprising two shafts 52 extending through a lateral surface 53 of wheel 9 and coaxial with each other and with a common axis 52*a* parallel to said axis of rotation, and two actuating brackets 54 fitted to shafts 52 and for rotating shafts 52 in opposite directions about axis 52*a*. Shafts 52 are fitted for rotation one inside the other, are fitted with walls 47 at the respective free ends, and move walls 47 between said closed and open positions to respectively grip and release packet 2 and respective sheet 3.

Each pocket 12 also comprises an extracting and folding device 55 for extracting packet 2 from pocket 11 when, in use, pockets 11 and 12 are aligned in direction D with respective seats 31 and 46 coincident with each other, and for folding sheet 3 about packet 2 to form a wrapping 4.

In addition to walls 47, device 55 comprises two supporting plates 56, which are located to the side of walls 47 outside seat 46, are fitted at the bottom ends to respective shafts 57 parallel to shafts 52, and are fitted at the top ends with respective folding plates 58 extending crosswise to plates 56 towards seat 46, and for folding portions 38 of a U-folded sheet 3 squarely on to surface 7. Device 55 also comprises two actuating brackets 59 fitted to shafts 57 and for rotating shafts 57 about their respective axes to move plates 58 to and from each other along respective substantially circular paths tangent to the edges of and over surface 7 of packet 2 housed inside seat 46.

In the event walls 47 are movable to and from each other, plates 58 strictly provide for folding portions 38 of sheet 3 squarely one on top of the other, the packet 2 inside seat 46 being gripped and retained mechanically by walls 47, which exert sufficient pressure on lateral surfaces 6 of packet 2 to withdraw packet 2 from seat 31 when, in use, the suction along conduits 36 and 37 is cut off or reduced.

Plates 58 are so positioned over lateral surface 7 as to substantially only engage portions 7*a* and 7*b* and leave a longitudinal gap 60 extending along superimposed portions 38, and which is engaged by a sealing device 61 associated with each pocket 12 and fitted to the edge of wheel 9.

Device 61 comprises a sealing head 62 and an actuating assembly 63 for activating head 62 and in turn comprising a substantially L-shaped arm 64 supporting head 62, a shaft 65 connected angularly to arm 64 and located to the side of respective pocket 12, and an actuating bracket 66 fitted to shaft 65 and for rotating head 62, about a respective axis parallel to said axis of rotation, between a raised position (FIGS. 1 and 7) and a lowered sealing position (FIG. 8) in which a sealing surface 67 of head 62 engages gap 60 to contact and seal portions 38.

Figure 14:
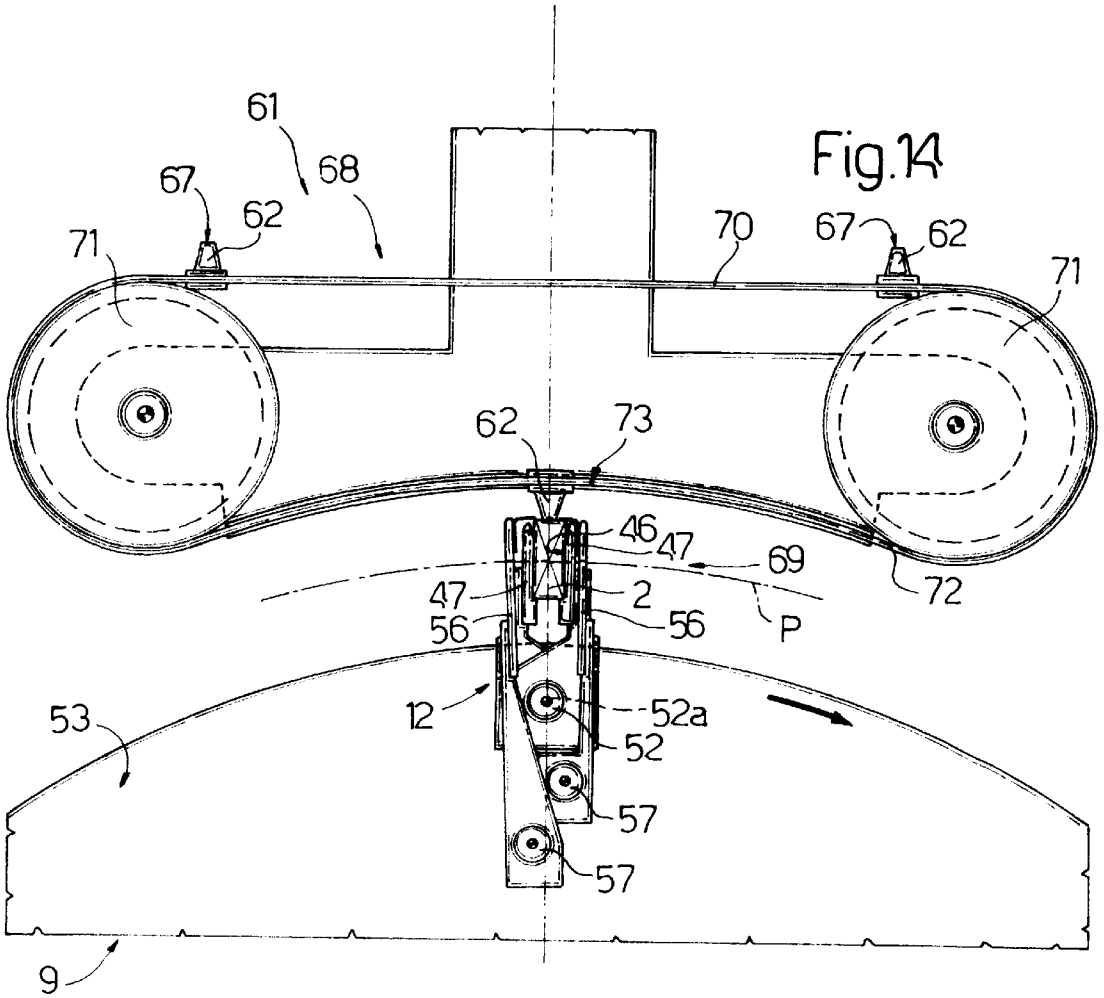
FIG. 14 shows a larger-scale view, with parts in section and parts removed for clarity, of a further variation of a further detail in FIG. 1.

The FIG. 14 embodiment shows an actuating assembly 68 similar to assembly 63, from which it differs by being located in a fixed position along the periphery of wheel 9 and at a sealing station 69 located downstream from station 10 and along the path P of pockets 12 in the rotation direction of wheel 9, and by comprising a number of sealing heads 62, which are fed by assembly 68 through station 69 in time with respective pockets 12.

Assembly 68 comprises a belt 70 supporting heads 62, and which is looped about two pulleys 71 (one of which is a drive pulley) and is deformed, along a forward branch 72 facing wheel 9, by a curved plate 73 for so curving branch 72 that heads 62 travel along the same circular path as pockets 12, i.e. gaps 60.

Operation will now be described assuming wheels 8 and 9 are operated in steps, and as of the instant in which a pocket 11 and a pocket 12 are aligned by wheels 8 and 9 in direction D at station 10. More specifically, at said instant, pocket 11 is set to the traveling position with a packet 2 retained inside seat 31 by suction along conduits 36, and with a sheet 3 closing opening 34 and retained centrally at portions 42 by plates 41 or by suction along conduits 45, and retained laterally at portions 38 by suction along conduits 37; and pocket 12 is set with walls 47 in the open position, and with plates 58 located to the side of edges 48 and on either side of and outwards of opening 49.

It should be pointed out, however, that, as already stated, wheels 8 and 9 may be rotated continuously, and pockets 11 and 12 may be movable in relation to respective wheels 8 and 9 and orientable in relation to each other as described and illustrated, for example, in U.S. Pat. No. 4,823,536.

As of the above instant, actuator 17 moves pocket 11 along guides 15 towards end portions 18 of guides 15 and into the transfer position (FIG. 5) in which seats 31 and 46 are coincident with each other; and, as pocket 11 is moved along guides 15, packet 2 is gradually inserted inside seat 46, and walls 47 and plates 56 are gradually inserted inside gaps 29 in pocket 11. More specifically, as walls 47 are inserted and sheet 3 engaged by respective rounded edges 48, the suction along conduits 37 is cut of simultaneously to release portions 38 and enable sheet 3 to be folded into a U (FIG. 10) about packet 2.

Once packet 2 is inserted fully inside seat 46, walls 47 are moved into the closed position, and one of plates 58 is rotated by respective shaft 57 on to surface 7 to intercept and squarely fold down a portion 38; at which point, pocket 11 is restored by actuator 17 to the traveling position, thus withdrawing packet 2 completely from seat 31.

As sheet 3 is being folded into a U, plates 41 or the suction along conduits 45 retain portions 42 of sheet 3 on surfaces 43 of walls 32 and, hence, portion 39 on surface 7 of packet 2 to prevent sheet 3 from slipping with respect to packet 2; and, once sheet 3 has been folded into a U, end portions 38 of sheet 3 extend parallel to respective surfaces 6 of packet 2, inside cavities 30 and from surface 7 contacting wall 33.

At this point, the other plate 58 (FIG. 7) is also rotated by respective shaft 57 on to surface 7 to intercept and squarely fold respective portion 38 on to the previously folded portion 38; and, when both plates 58 are positioned on surface 7, sealing device 61 moves head 62, by means of assembly 63 (FIG. 8), into a position partially closing gap 60 to seal portions 38 together and form tubular wrapping 4. Head 62 is kept with surface 67 contacting superimposed portions 38 for as long as it takes to seal portions 38, during which time, wheel 9 rotates one step forward to feed another pocket 12 into station 10.

In the event sealing device 61 features a number of heads 62 operated by assembly 68 and fed through station 69 in time with respective pockets 12, portions 38 are sealed as pocket 12 with respective packet 2 is fed through station 69. More specifically, belt 70 is so operated as to feed heads 62 through station 69 at the same traveling speed as pockets 12 along path P, and heads 62 first engage gap 60 and are then maintained contacting superimposed portions 38 by plate 73.

As already stated, plates 58 provide solely for folding portions 38, packet 2 being retained inside seat 31 by walls 47 in the closed position, so that, in the event walls 47 are movable, plates 58 may be replaced by known folding devices (not shown) located outwards of wheel 9 along path P.

Figure 13:
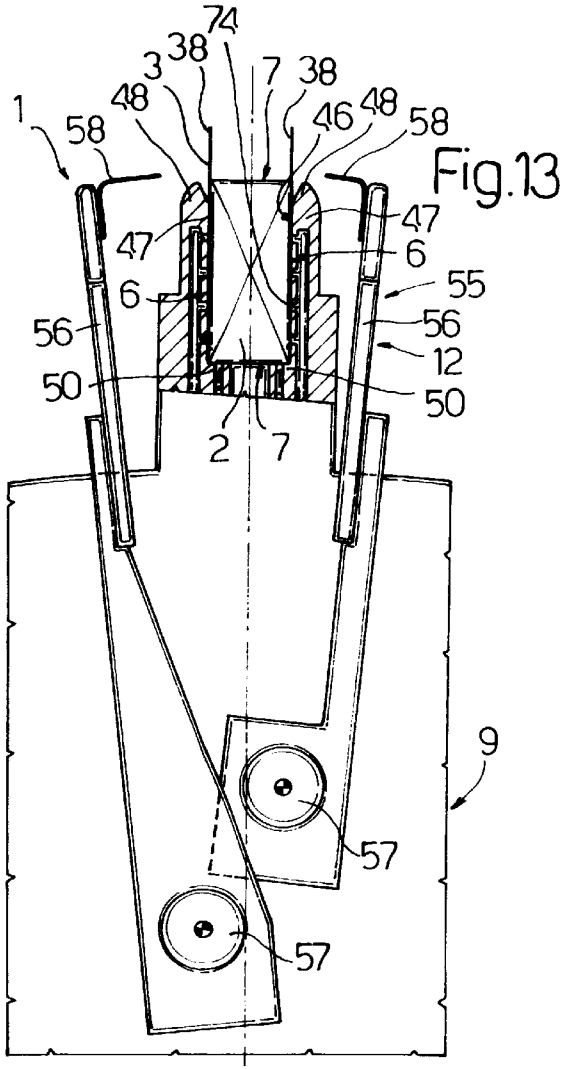
FIG. 13 shows a smaller-scale view, with parts in section and parts removed for clarity, of a variation of a detail in FIG. 1.

The FIG. 13 embodiment shows a pocket 12 comprising fixed, parallel walls 47 separated by a distance greater than the thickness of packet 2 to enable packet 2 to be inserted together with respective sheet 3 inside seat 46. In this case, besides folding portions 38, plates 58 also provide for retaining packet 2 as it is withdrawn from seat 31 and as portions 38 are being sealed. Therefore, to retain packet 2 enclosed in wrapping 4 inside seat 46 once packet 2 is released by plates 58, walls 47 comprise a number of conduits 74 communicating at one end with a known suction device (not shown) and at the other end with seat 46.

We claim:

1. A unit for wrapping packets of prismatic shape defined longitudinally by two ends (5) and laterally by pairs of opposite lateral surfaces (6,7); said unit (1) comprising:

a first and second conveyor (8,9) movable through a transfer station (10);

said first conveyor (8) including at least a first pocket (11) defining a first seat (31) for receiving and containing a respective packet (2);

said second conveyor (9) including at least a second pocket (12) defining a second seat (46) for receiving and retaining said packet (2); and a transfer means (14) for transferring the packet (2) from said first seat (31) to said second seat (46) at the transfer station (10).

2. A unit as claimed in claim 1, wherein said first pocket (11) comprises a first pair of engaging lateral walls (32) defining said first seat (31) and said second pocket (12) comprises a second pair of engaging lateral walls (47) defining said second seat (46);

said first pair of lateral walls (32) defining a longitudinal opening (34) of said first seat (31) and engaging a respective said packet (2) by said ends (5); and said second pair of lateral walls (47) being positioned crosswise to said first pair of lateral walls (32) to en gage a respective said packet (2) by said first pair of lateral surfaces (6).

3. A unit as claimed in claim 2, wherein said unit (1) includes retaining means (13) for releasably retaining a sheet (3) of wrapping material positioned substantially closing said longitudinal opening (34).

4. A unit as claimed in claim 3, wherein said retaining means (13) are located laterally with respect to said longitudinal opening (34).

5. A unit as claimed in claim 4, wherein said retaining means (13) are located on either side of said longitudinal opening (34) and associated with said first pair of lateral walls (32).

6. A unit as claimed in claim 3, wherein said retaining means (13) includes at least one gripping element (40) movable between a retaining position retaining said sheet (3) substantially closing said longitudinal opening (34), and a release position; said gripping element (40) being connected to a respective lateral wall (32) of said first pair of lateral walls (32).

7. A unit as claimed in claim 3, wherein said retaining means (13) includes pneumatic means (45) for pneumatically retaining a respective sheet (3) substantially closing said longitudinal opening (34).

8. A unit as claimed in claim 3, wherein said transfer means includes actuating means (14) for moving one of said pockets (11, 12) towards the other so that said seats (31, 46) are positioned coincident with each other.

9. A unit as claimed in claim 8, wherein said transfer means (14) includes actuating means (14), in turn, having a guide (15) fitted to the first conveyor (8);

a slide (16) supporting the first pocket (11), the slide (16) being movable along said guide (15); and an actuator (17) for moving the slide (16) and said first pocket (11) along the guide (15) towards and away from a position where the first and second seat (31,46) are coincident.

10. A unit as claimed in claim 3, wherein said first pocket (11) includes two gaps (29) located on either side of the first seat (31) and communicating with each other via the first seat (31); said retaining means (13) retaining a respective sheet (3) partially closing the two gaps (29) and said longitudinal opening (34).

11. A unit as claimed in claim 10, wherein said second pocket (12) includes engaging means (47) in turn comprising said second pair of lateral walls (47) and which are inserted inside said gaps (29) to engage a packet (2) housed inside said first seat (31) and fold said sheet (3) of wrapping material into a U about the packet (2).

12. A unit as claimed in claim 11, wherein said unit (1) includes folding means (58) movable with respect to said second seat (46) to fold at least one end portion (38) of said sheet (3) of wrapping material on to one of said lateral surfaces (7).

13. A unit as claimed in claim 12, wherein the lateral walls (47) in said second pair of lateral walls (47) are fixed lateral walls; said folding means (58) being fitted to said second conveyor (9) and being associated with said second pocket (12) to retain the respective packet (2) inside the respective second seat (46).

14. A unit as claimed in claim 12, wherein the lateral walls (47) in said second pair of lateral walls (47) are movable to and from each other between an open position in which said packet (2) is substantially housed inside the second seat (46), and a closed position in which said packet (2) is housed completely inside the second seat (46) and retained inside the second seat (46) by the lateral walls (47).

15. A unit as claimed in claim 14, wherein said folding means (58) are fitted to said second conveyor (9) and associated with said second pocket (12) to fold at least one end portion (38) of said sheet (3) of wrapping material on to one said lateral surface (7).

16. A unit as claimed in claim 12, wherein said unit (1) includes folding means (58) movable with respect to the second seat (46) to fold two end portions (38) of said sheet (3) one on top of the other and so form a tubular wrapping (4) about said packet (2).

17. A unit as claimed in claim 16, wherein said unit (1) includes sealing means (61) movable to and from a sealing position contacting said two folded end portions (38) to join the two end portions (38) firmly to each other.

18. A unit as claimed in claim 17, wherein said sealing means (61) are fitted to said second conveyor (9) and associated with said second pocket (12).

19. A unit as claimed in claim 17, wherein said second conveyor (9) extends along a given path (P) to feed said tubular wrapping (4) along the path (P); said sealing means (61) being located along said path (P).

20. A unit for wrapping packets of prismatic shape defined longitudinally by two ends (5) and laterally by pairs of opposite lateral surfaces (6,7); said unit (1) comprising:

a first and second conveyor (8,9) movable through a transfer station (10);

said first conveyor (8) including at least a first pocket (11) defining a first seat (31) for receiving and containing a respective packet (2);

said second conveyor (9) including at least a second pocket (12) defining a second seat (46) for receiving and retaining said packet (2);

a transfer device (14) adapted to transfer the packet (2) from said first seat (31) to said second seat (46) at the transfer station (10);

wherein said first pocket (11) comprises a first pair of engaging lateral walls (32) defining said first seat (31) and said second pocket (12) comprises a second pair of engaging lateral walls (47) defining said second seat (46);

said first pair of lateral walls (32) defining a longitudinal opening (34) of said first seat (31) and engaging a respective said packet (2) by said ends (5); and said second pair of lateral walls (47) being positioned crosswise to said first pair of lateral walls (32) to engage a respective said packet (2) by said first pair of lateral surfaces (6);

said transfer device (14) including actuating means (14), in turn, having a guide (15) fitted to the first conveyor (8);

a slide ( 16) supporting the first pocket (11), the slide (16) being movable along said guide (15); and an actuator (17) for moving the slide (16) and said first pocket (11) along the guide (15) towards and away from a position where the first and second seat (31,46) are coincident.

* * * * *